United States Patent [19]

Jungman

[11] Patent Number: 4,496,277

[45] Date of Patent: Jan. 29, 1985

[54] LIFTING DEVICE AND METHOD

[75] Inventor: Emil A. Jungman, Escondido, Calif.

[73] Assignee: Jungman, Inc., Monroe, La.

[21] Appl. No.: 367,437

[22] Filed: Apr. 12, 1982

[51] Int. Cl.[3] ..... B66C 23/32

[52] U.S. Cl. ..... 414/589; 212/202; 254/108; 414/11; 414/786

[58] Field of Search ..... 414/10, 11, 12, 589, 414/663, 786; 212/199, 166, 187, 202, 203; 187/2; 254/105, 108, 89 H

[56] References Cited

U.S. PATENT DOCUMENTS

| | | | |
|---|---|---|---|
| 1,111,099 | 9/1914 | Sawyer | 212/199 |
| 1,834,652 | 12/1931 | Schmid . | |
| 2,103,530 | 12/1937 | Henry | 37/144 |
| 2,588,458 | 3/1952 | Allphin et al. | 214/100 |
| 2,780,373 | 2/1957 | Westmark | 214/95 |
| 2,928,556 | 3/1960 | White | 212/202 X |
| 3,127,996 | 4/1964 | Schwing | 212/57 |
| 3,153,486 | 10/1964 | Strnad | 214/89 |
| 3,207,263 | 9/1965 | Cull | 187/2 |
| 3,223,199 | 12/1965 | Schwehr | 187/2 |
| 3,261,477 | 7/1966 | Powell | 212/134 |
| 3,307,713 | 3/1967 | Bopp | 212/55 |
| 3,464,169 | 9/1969 | Potain | 52/115 |
| 3,516,513 | 6/1970 | Robertson et al. | 182/19 |
| 3,536,161 | 10/1970 | Clarke | 187/8.59 |
| 3,656,631 | 4/1972 | Rauch et al. | 212/57 |
| 3,759,349 | 9/1973 | Sieffert | 187/2 |
| 3,763,964 | 10/1973 | Davis | 187/2 |
| 3,951,236 | 4/1976 | Schreiber | 187/2 |
| 4,125,193 | 11/1978 | Matsumoto | 212/64 |
| 4,272,932 | 6/1981 | Wappler | 52/118 |

*Primary Examiner*—Robert J. Spar
*Assistant Examiner*—Janice Krizek
*Attorney, Agent, or Firm*—Norvell E. Von Behren

[57] ABSTRACT

A lifting device and method of using the device is disclosed. The device and method may be used to stock a structure such as a high-rise building under construction or an off-shore gas or oil drilling rig. The device in the preferred embodiment contains a pair of booms carried by a pair of boom carriages which are pivoted on a frame attached to the outside of the structure. The booms are capable of moving transversely on the frame and longitudinally within the boom carriages. A trolley and disappearing cargo block are positioned in the booms. Self-climbing features may also be incorporated in the device for stocking several elevations of the structure. The novel device also allows longer cargo to be lifted and turned approximately 90° and moved into the structure. The device may also be installed permanently on the structure and positioned in a non-operative vertical position and pivoted to an operative horizontal position.

8 Claims, 11 Drawing Figures

LIFTING DEVICE AND METHOD

BACKGROUND OF THE INVENTION

This invention relates generally to construction lifts and more particularly to a self-climbing high-rise lift for use on the outside of a building under construction in the preferred embodiment.

In the erection of high-rise type buildings consisting of a large plurality of floors, it is common to erect on the outside of the steel construction a plurality of man-lifts which are utilized for the stocking of the respective floors with the material needed to complete those floors. There is also usually constructed prior to the erection of the steel in the building, a crane known as a tower crane which is designed to be used to lift the steel to be erected into its skeleton shape. The tower crane is also utilized for the lifting of outside facing panels on the building if such panels are incorporated into the design.

Other forms of lifting devices common in building construction would consist of guy derricks which go up with the building approximately every three floors and can be used also to put up the steel in the building. A problem encountered with guy derricks is that they cannot be used to erect the facing panels of the building. The previously described man-lift, fastened on the side of the building is generally not capable of lifting the facing panels without special handling. In order to use a man-lift for facing panels, the panels must first be positioned upright in the man-lift and then removed from the top of the man-lift at the appropriate floor. This procedure becomes expensive since it is time-consuming. It is also known in the construction industry to lift the facing panels with a stiff-legged crane or a Chicago boom which has been mounted on the outside of the building. The use of each type of separate lift becomes expensive also thereby raising the overall cost of building erection.

Inasmuch as the cost of renting a tower crane can be approximately 25 thousand dollars per month which would include the rental of the crane and the use of two operators and insurance on the crane, it can be seen how the use of the tower crane for purposes of lifting facing panels and lifting other heavy objects up to the building erection site becomes very costly.

Other problems encountered with the use of a tower crane are inherent in the crane's structure. For example, a tower crane takes 6 to 12 hours to raise three floors with its associated counterweights and all of the equipment needed for the crane. Since the tower crane is generally tied to the steel structure for a distance of at least five floors it can be seen that there is a massive amount of weight in the range of two-hundred seventy thousand pounds which can be eliminated during construction if the tower crane itself can be eliminated.

SUMMARY OF THE INVENTION

In order to overcome problems inherent in the before mentioned types of construction lifting devices such as the tower crane and the man-lifts which are utilized for stocking the interior of the building and for raising the exterior facing panels, there has been provided by the applicant's invention in the preferred embodiment a new and novel high-rise lifting device for use on the outside of a building under construction. The applicant's lifting device is capable of being designed so that all of the man-lifts of the building may be eliminated with the exception of only one man-lift which is then used primarily for lifting of construction personnel. The applicant's new and novel lift of the preferred embodiment is capable of being utilized for the lifting of the outside facing panels on the side of the building should these panels be utilized in the construction of the building. The applicant's lifting device is also capable of lifting and turning loads approximately 90° and then moving the loads into the building structure. In addition, the applicant's self-climbing feature on his lift of the preferred embodiment makes the lift caable of being used for completely stocking an entire floor of the building under construction with the materials necessary to finish the floor such as dry wall, air conditioning equipment, plumbing equipment and the like and then moving to the next floor. It should be noted that the applicant's lift makes it possible to lift and deliver a load into each floor, in one lift, with a minimum of material handling expense, a capability which will become apparent from a review of the hereinafter description of the preferred embodiment.

The applicant's new and novel self-climbing high-rise lift as taught in the preferred embodiment comprises a generally vertical frame structure which has at least one horizontally movable boom carried by a boom carriage which is pivotably mounted on the vertical frame. The boom is designed for longitudinal movement within predetermined limits within the boom carriage into and out of the building. In the preferred embodiment of the invention there would be provided two horizontally movable booms mounted side by side in similar boom carriages. The boom carriages are designed to be moved transversly of each other by a single operator. The two booms of the applicant's design, with their attached trolleys and cargo blocks would be capable of lifting the large and bulky facing panels in a manner that would be less affected by wind currents against the panels. The booms may be activated to position them horizontally into and out of the building to a desired position and to operate them to lift a desired load with their attached trolleys and cargo blocks. The means to activate the device may comprise in part a plurality of hydraulic motors and their associated hydraulic control circuts, cables, and miscellaneous parts. The boom carriages may be pivoted to a non-operative vertical position on the outside of the building and may be pivoted to an operative horizontal position partly within and partly without the building.

The applicant's novel lift maybe bolted to the outside of the building shell and may self-climb upwardly or downwardly as desired. When using the self-climbing features, the device would have attached to a lower portion of the generally vertical frame, a plurality of lower mounting means in the form of a pair of outriggers which are used for attachment to a lower floor of the building structure. Before the floor concrete is poured in the building, a plurality of high-strength bolts are positioned upwardly on the girder at the outer edge of the floor in the vicinity where the applicant's new and novel high-rise lift will be mounted. The lower outrigger mounting means then are attached to these bolts. The upper portion of the generally vertical frame contains a plurality of intermediate mounting means in the form of a pair of outriggers which are also mounted on bolts as before mentioned. The lower outrigger mounting means and intermediate outrigger means are both designed for quick attachment to the bolts so as to be easily removed from the previously mounted bolts whenever the high-rise lift is moved to the next succeeding floor. When the lift is normally used, the lower and intermediate outriggers only would be bolted to the anchor bolts in those floors.

A lifting means, attached to the upper portion of the generally vertical frame, is utilized for lifting the vertical frame and its booms to the next succeeding floor of the building when it is desired to move the lift. The lifting means would comprise in part a pair of hydraulic rams being positioned vertically within the vertical portion of the frame in the preferred embodiment. The rams have mounted thereon upper mounting means in the form of a pair of outriggers which are attached to the hydraulic rams and which may also be attached to an upper floor of the building structure on the previously mentioned high-strength bolts.

In moving the high-rise lift from one floor to the other when using the self-climbing feature, the moving sequence would be to extend the upper hydraulic rams to the next succeeding floor. The attached pair of outriggers on the upper mounting means would be fastened to the bolts in that floor. Thereafter, the intermediate and lower mounting means outriggers would be disconnected from the bolts in that floor and the upper hydraulic rams would be utilized for lifting the entire frame structure with its two booms and associated items up to the next succeeding floor. Thereafter the intermediate and lower mounting means outriggers would be re-attached to the floor bolts adjacent these outriggers and the upper mounting means outriggers attached to the upper hydraulic rams would be disconnected from the floor bolts to be ready for the next succeeding move.

Accordingly, it is an object and advantage of the invention to provide a new and novel lifting device for a structure such as a high rise building under construction, an off-shore drilling rig or the like having a novel boom and carriage structure that is pivotable on a frame which allows the boom and boom carriage to be positioned horizontally in an operative position partly in the building or rig and partly outside of the building or rig.

Another object and advantage of the invention is to provide a pivoting boom and boom carriage for a lift which is capable of being raised to a vertical non-operative position on the outside of the building or rig.

Yet another object and advantage of the invention is to provide a new and novel lifting device that is fastened to a building or rig and is capable of lifting elongated loads to a desired elevation and then turning the loads approximately 90° and moving them longitudinally into the building or rig.

Still another object and advantage of the invention is to provide a new and novel lifting device having a novel arrangement of a boom positioned in a boom carriage and having a trolley and disappearing cargo block positioned for motion within the boom.

A further object and advantage of the invention is to provide a new and novel lifting device having improved lifting features and also having self-climbing features that allow the novel method of stocking a floor to be accomplished.

Another object and advantage of the invention is to provide a new and novel self-climbing high-rise lift which may be moved from floor to floor on the outside of the building sturcture and which may be attached to the building by a plurality of lower, intermediate, and upper mounting means in the form of a plurality of removably mounted outriggers. The outriggers are attached to previously mounted high-strength bolts which are positioned on girders, at pre-determined positions, in the outer edge of the building under construction.

A further object and advantage of the invention is to provide a new and novel lifting device that is capable of stocking each floor of a construction structure with all the required components for finishing the floor, as well as the facing panels for the outer surface of the building.

These and other objects and advantages of the invention will become apparent from a review of drawings and from a study of the description of the preferred embodiment which has been given by way of illustration only.

BRIEF DESCRIPTION OF THE DRAWINGS

In FIG. 2 there can be seen one of the lower mounting means in the form of an outrigger and the intermediate mounting means also in the form of a plurality of removeably mounted outriggers;

DESCRIPTION OF THE PREFERRED EMBODIMENT

Figure 1:
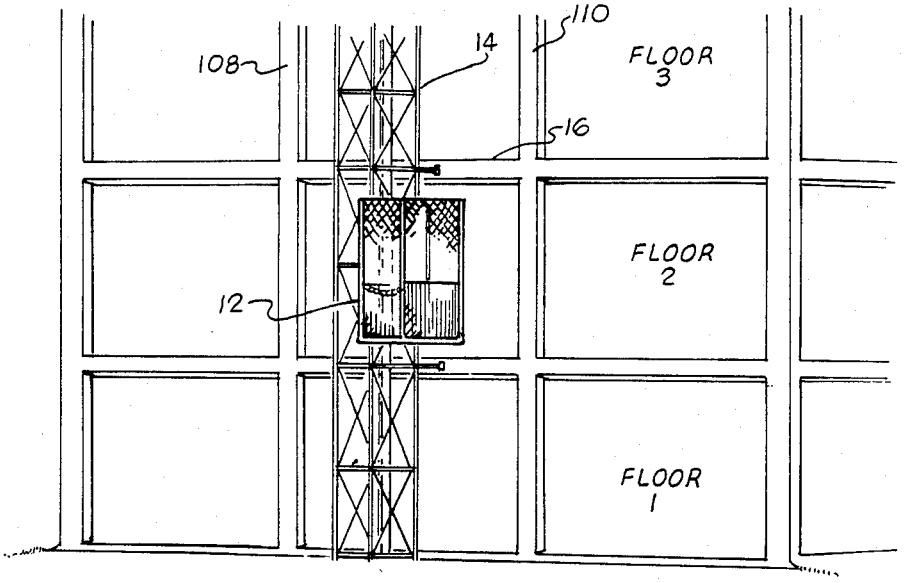
FIG. 1 is a side view of a plurality of floors in a building under construction showing the position of a typical man-lift which will be replaced by the applicant's self-climbing lift.
Figure 2:
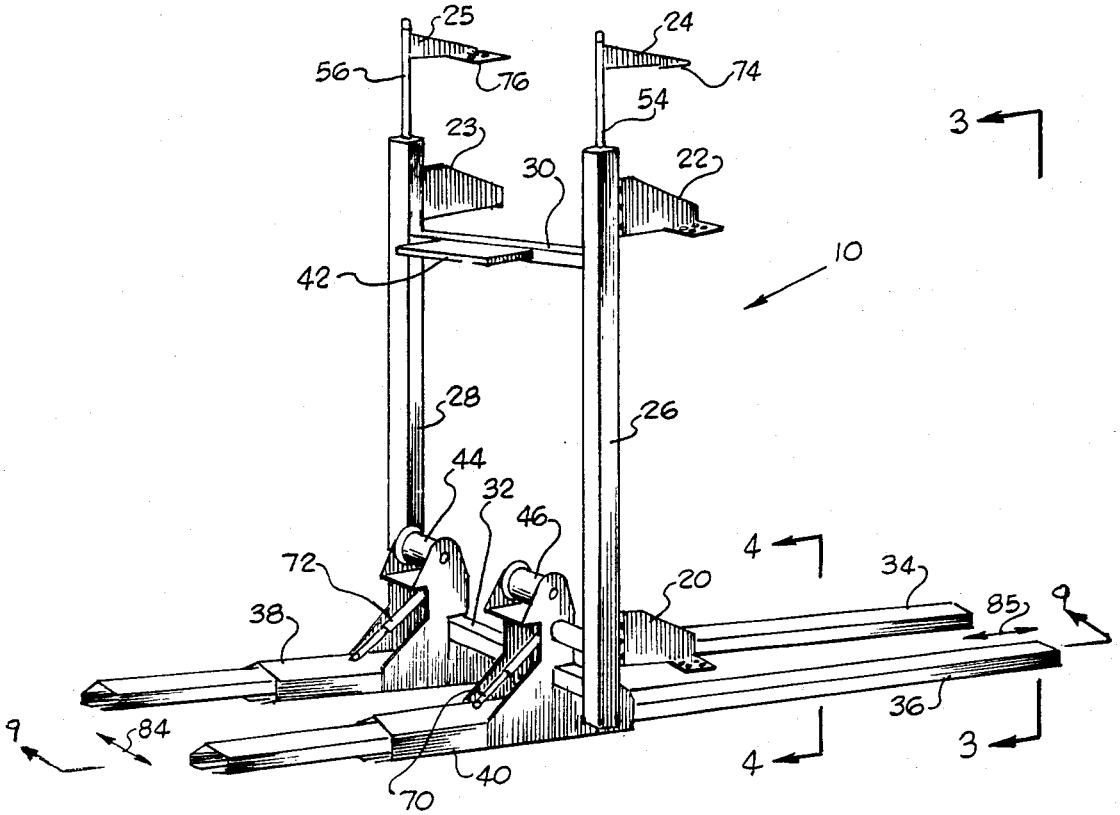
FIG. 2 is a perspective view showing the applicant's self-climbing lift and showing the generally vertical frame structure and the plurality of horizontally moveable booms mounted on the vertical frame.

Referring now to the drawings in general and in particular to FIGS. 1 and 2 of the drawings there is shown in FIG. 2 the applicant's self-climbing hgh-rise lift shown generally by the numeral 10. The lift 10 would be designed to be positioned on the outside of the steel and concrete portion of the building under construction. FIG. 1 shows a typical man-lift 12 positioned for vertical movement along a track 14 which has been fixedly attached to the framework 16 of a high-rise building under construction. The man-lift 12 is then capable of servicing the various floors of the building under construction such as the first three floors shown in FIG. 1 in addition to the remaining floors above the man-lift. A typical high-rise building under construction may have two or more man-lifts and may have up to five or six man lifts depending upon the size of the building. The applicant's lift 10 shown in FIG. 2 would replace all the man-lifts 12 of the type shown in FIG. 1 except one which would be used primarily for lifting construction workers.

Figure 5:
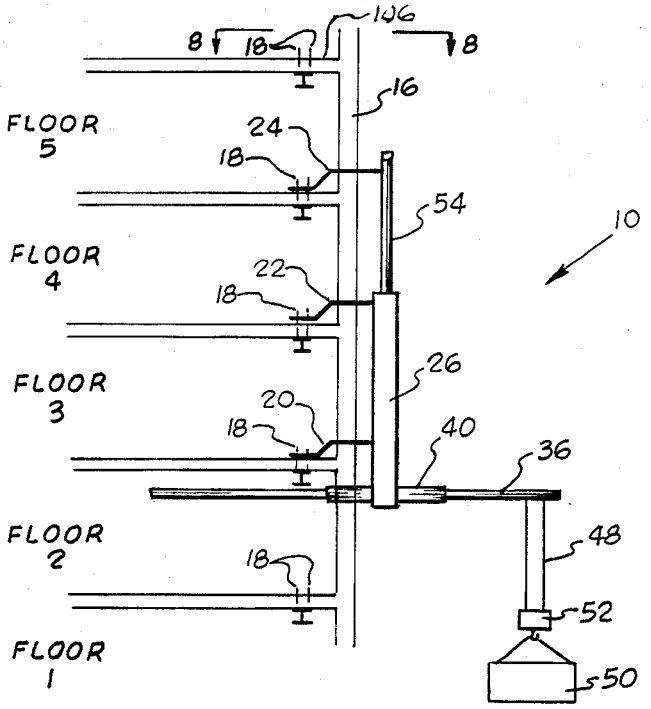
FIG. 5 is a vertical sectional view through a typical building under construction and showing the applicant's self-climbing high-rise lift as it would be mounted on the outside of the building structure. There can also be seen in FIG. 5 the plurality of high-strength steel bolts which had previously been positioned in the building floors and upon which the lower, intermediate, and upper mounting means in the form of a plurality of outriggers are rigidly attached in order to firmly lock the novel lift to the building structure during use of the lift.

The applicant's new and novel self-climbing lift 10 is designed to be positioned in the same position as the existing man-lifts 12 shown in FIG. 1 and is designed to be positioned on the outside of the existing building skeleton also as shown in FIG. 5 of the drawing. It can be seen in FIG. 5 how the man-lift 12 has been replaced by the applicant's new and novel self-climbing lift 10 which is shown in position for servicing the second floor of a building under construction. The lift 10 is shown in FIG. 5 attached to floor 3 and floor 4 and also is shown attached to floor 5 which will be described more fully hereinafter.

As has been previously mentioned, a plurality of high-strength bolts 18 (shown in FIG. 5) have been affixed to girders along the outer edge of the various floors of the building under construction whenever the concrete is poured. The bolts 18 are positioned in a predetermined position on each floor. A plurality of outriggers 20, 21, 22 and 23 shown in FIGS. 2, 3 and 5 as well as a plurality of outriggers 24 shown in FIGS. 2 and 5 are then fastened to the bolts 18 to hold the applicant's lift firmly on the side of the building. The outriggers 20, 21, 22, and 23 form respectively the lower mounting means, and the intermediate mounting means which are attached to the generally vertical frame 26 and 28 which are in turn fixedly attached to the horizontally positioned frames 30 and 32. The outriggers 24 and 25 form the upper mounting means and are attached to a pair of hydraulic rams which will be more fully described hereinafter. The frames 26, 28, and 32 form the generally vertical frame structure which supports a pair of horizontally positioned booms 34 and 36 which are slideably positioned within boom carriages 38 and 40. The boom carriages 38 and 40 are carried by the horizontally positioned frame 32 and are designed for transverse movement along the side of the building within predetermined limits as will be described more fully hereinafter. A hydraulic power unit, not shown in the drawing, is designed to be positioned on a tray 42 which is fixedly attached to the horizontally positioned frame 30. The hydraulic power unit, positioned on the tray 42 is designed to be used to actuate a plurality of drums 44 and 46 to wind the cables 48 to lift the load 50 with the cargo block 52 for lifting baskets as desired by the crane user. For purposes of clarity, the hydraulic power unit, hydraulic tubing and various cables used to lift the lifting hook 52 have not been shown in detail in the various figures of the drawing. It is sufficient to say that the horizontally positioned booms 34 and 36 are capable of sliding horizontally in the boom carriages 38 and 40 in order to be able to position loads 50, shown in FIG. 5 of the drawing, to the inside of the second floor to deposit the loads on the floor for ultimate use by the interior construction workers.

It should also be clear that the use of two horizontally positioned booms 34 and 36, each having a cable 48 and associated cargo block 52 allows the operator of the applicant's self-climbing lift to use the block 52 to lift large elongated sections of facing panels up the side of the building against the face of the building where the facing panels can be then turned and positioned in the building interior. With the use of the two horizontal booms 34 and 36, positioned side by side, the facing panels will be relatively free from erratic movement during lifting which may be caused by sudden gusts of wind. Previous use of tower cranes with only one cable mechanism and cargo block would often times result in twisting and turning of the facing panels whenever the wind gusts became too strong resulting in a shutdown of the facing operation until the wind diminished.

Figure 7:
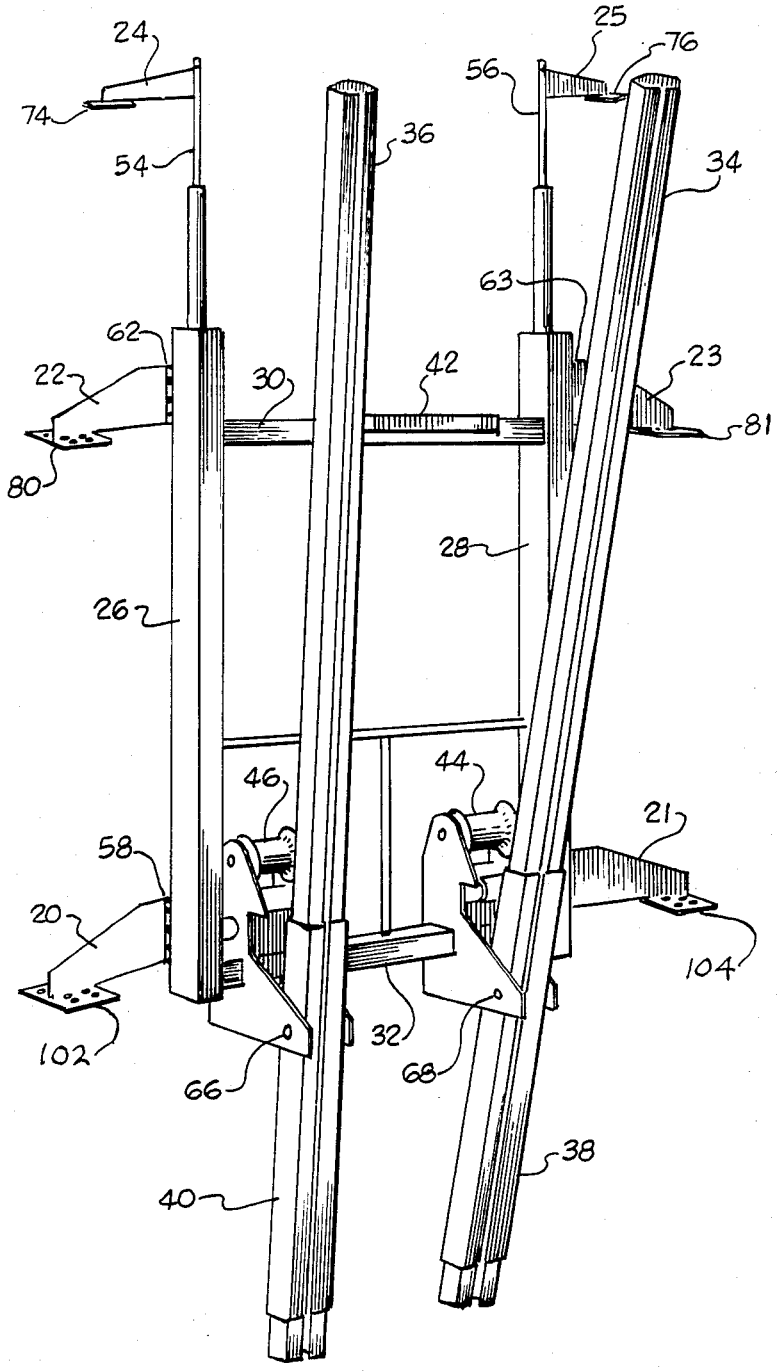
FIG. 7 is a perspective view of the applicant's new and novel self-climbing lift showing the boom carriages and the booms being vertically positioned by a plurality of hydraulic rams into the position that they would be held prior to the lift being moved from one floor to the next succeeding floor.

Referring now to FIG. 5 of the drawing there will be described in further detail how the applicant's new and novel high-rise lift becomes a self-climbing lift. In FIG. 5 it can be seen that the parallel booms 34 and 36 are positioned with the frames 26 and 28 being vertically positioned on the outside of the building steel 16. During use of the applicant's lift the lower outriggers 20 and 21 are fixedly attached to the plurality of bolts 18 embedded in the third floor concrete and the intermediate outriggers 22 and 23 are fixedly attached to the plurality of bolts 18 positioned in the concrete of the fourth floor. When it is desired to move the complete high-rise lift to service the next floor, for example the third floor, a pair of hydraulic rams 54 and 56 are activated. The upper end of the rams 54 and 56 are connected to the upper outriggers 24 and 25. The hydraulic rams 54 and 56 are then extended in an upward direction as shown in FIG. 5 so that the upper outriggers 24 and 25 may be bolted to the previously positioned bolts 18 embedded in floor 5. After the outriggers 24 and 25 have been tightly positioned on the bolts 18 in floor 5, then the intermediate outriggers 22 and 23 as well as the lower outriggers 20 and 21 may be released from their bolts 18 positioned in their respective floors. The outriggers 20, 21, 22 and 23 may be swung outwardly as shown in FIG. 7 of the drawing. It should be noted in FIG. 7 that the outriggers 20, 21, 22 and 23 may be designed to be hinged on a plurality of pins 58, 60, 62 and 63 or they may be designed to be removed from the horizontally positioned frames 26 and 28 in other ways, so as to allow the lift 10 to self-climb or move to the next succeeding floor by means of the use of the hydraulic rams 54 and 56.

Prior to self-climbing the two booms 34 and 36 would be positioned to the position shown in FIG. 7 of the drawing by pivoting them about the pins 66 and 68 to the vertical position shown. This would be accomplished by the use of a pair of hydraulic rams 70 and 72 shown in FIG. 2 of the drawings. When positioned thusly, the entire lift 10 is able to be lifted upwardly to the next succeeding floor by the use of the hydraulic rams 54 and 56 with the sole connections to the building structure during the lift being through the upper outriggers 24 and 25 and their bolts 18 embedded in the concrete. After the lift 10 is moved upwardly, the intermediate outriggers 22 and 23 as well as the lower outriggers 20 and 21 may be swung into position or positioned by other means to fixedly bolt the entire lift structure to the side of the building. In the embodiment shown, the outriggers are designed to be pivotable but it is within the spirit and scope of the invention that they could be made to be quickly disconnected from their frames during the lifting process.

Figure 6:
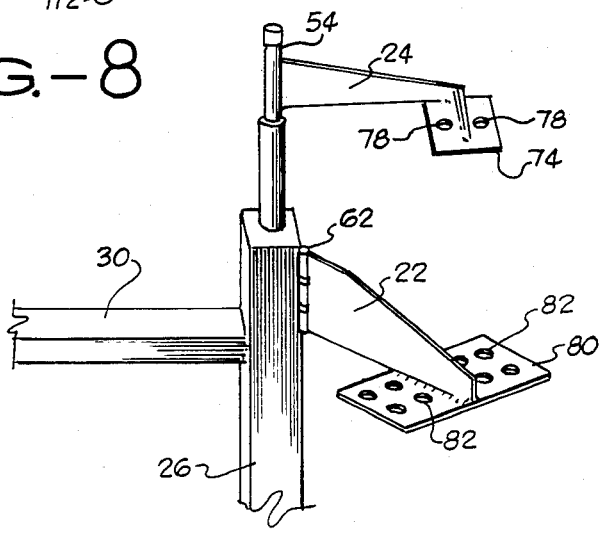
FIG. 6 is a partial perspective view of the intermediate mounting means outriggers and the upper mounting means outriggers and how the mounting means are positioned on the various parts of the generally vertical frame and the hydraulic rams so that they may be quickly attached to and removed from the previously described high-strength bolts as desired.

Referring now to FIG. 6 of the drawings, there can be seen in greater detail how the hydraulic rams 54 and 56 may be positioned inside the vertical frames 26 and 28 so that only the rods of the rams are exposed upwardly so that the upper outriggers 24 and 25 can be attached thereto. It can also be seen in FIG. 6 and FIG. 3 how a pair of plates 74 and 76 are fixedly attached to the upper outriggers 24 and 25 with the plates containing a plurality of holes 78 designed to receive the high-strength bolts 18 previously embedded in various floors. There can also be seen in FIG. 6 and in FIG. 3 the intermediate outrigger 22 which may be pinned to the frame 26 by means of the pin 62 and which contains a plate 80 containing a plurality of holes 82 which are also designed to be positioned over the matching bolts 18 embedded in the floor adjacent to the outrigger. The opposite outrigger 23 is also pinned to the frame 28 by means of a pin 63 and contains a plate 81 containing a plurality of holes 82 designed to be positioned over the bolts 18 embedded in the floor adjacent to the outrigger.

Figure 3:
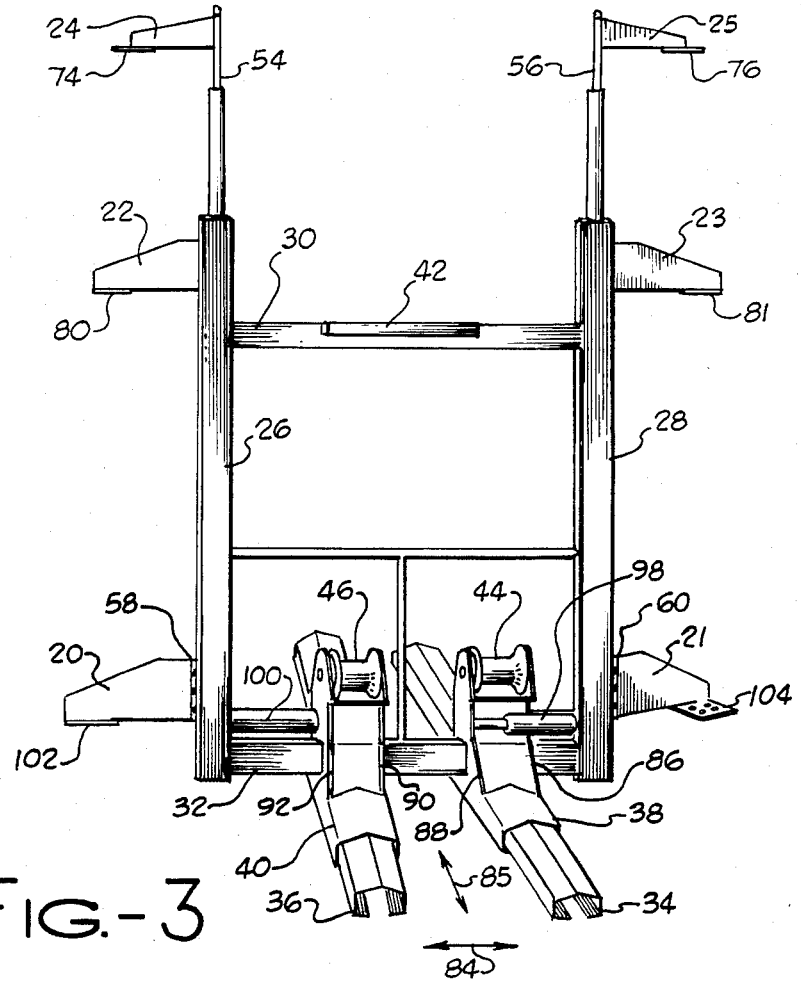
FIG. 3 is an end view, taken along line 3—3 of FIG. 2 showing the applicant's self-climbing lift in the operating position and as it would be positioned on the outside of a building under construction in the position to replace the man-lift shown in FIG. 1.

Referring now to FIG. 3 of the drawing there can be seen an end view, looking along lines 3—3 of FIG. 2, showing in greater detail the positioning of the two horizontal booms 34 and 36 on the lower frame 32 and also showing in somewhat greater detail how the booms 34 and 36 may be positioned to move transversely along the side of the building within predetermined limits on the frame 32. The booms 34 and 36 may move in the direction shown by the arrow 84 relative to each other to allow the two booms 34 and 36 greater flexibility in picking up large elongated loads such as facing panels.

The boom carriage 38 is slidably carried by the lower frame 32 by means of the upright plates 86 and 88 and in a similar manner the boom carriage 40 is slidably carried on the lower frame 32 by means of the plates 90 and 92. A horizontally positioned plate 94 is welded to the upper portions of the plates 86 and 88 and serves to carry the cable winding drum 44. In a similar manner a horizontally positioned plate 96 is welded to the plates 90 and 92 and is designed to carry the cable winding drum 46. As has been previously mentioned, the cable winding drums 44 and 46 are utilized to wind the cables positioned within the booms 34 and 36 to lift the cargo blocks 52. The cable winding drums 44 and 46 are activated by the hydraulic power unit, previously discussed, which has been positioned on the vertically positioned tray 42. A hydraulic ram 98 is positioned against the upright frame 88 so as to be able to be activated to move the boom carriage 38 and boom 34 horizontally along the lower frame 32 in the direction shown by the arrow 84. In a similar manner the other boom carriage 40 also contains a hydraulic ram 100 which is designed to enable the boom carriage 40 and boom 36 to be moved horizontally in the direction shown by the arrow 84.

Figure 4:
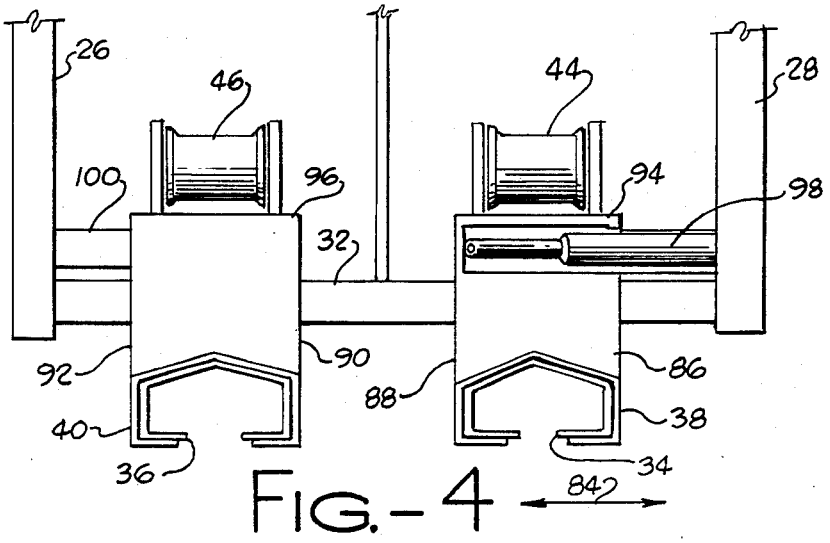
FIG. 4 is an enlarged view, taken along line 4—4 of FIG. 2, showing the pair of boom carriages of the preferred embodiment and showing the positioning of the horizontally positioned booms within the boom carriages and further showing the driving drums for the booms. There is also shown in FIG. 4, a partial cutaway sectional view of the right hand boom showing a hydraulic ram which is utilized to move the boom horizontally along the direction of the outer edge of the building towards and away from the adjacent boom. Both the right-hand and the left-hand booms would be constructed in the preferred embodiment with a hydraulic ram for purposes of precise positioning of the booms relative to each other.

The construction of the sliding parts necessary to move the boom carriages 38 and 40 in the direction shown by the arrow 84 such as bearings or the like are not shown in the drawings for purposes of clarity. In a similar manner the various sliding parts necessary to enable the boom 34 and 36 to slide in and out of the carriages 38 and 40 in the direction shown by the arrow 85 have not been shown. In the preferred embodiment, the booms cross-sectional shape will take the form generally shown in FIG. 4 of the drawing for purposes forming no part of the application and will be described in full in other applications to be filed by the applicant in the near future.

Referring also to FIG. 3 of the drawing it can be seen how the lower outriggers 20 and 21 may be pinned, by means of the pins 58 and 60 to the lower portions of the vertically positioned frames 26 and 28. The lower outriggers 20 and 21 would also have fixedly attached thereto a plate 102 and 104 of the same configuration as the plates 80 and 81 positioned on the intermediate outriggers 22 and 23. The plates 102 and 104 would also contain a plurality of holes designed to receive the bolts 18 positioned in the concrete floors as previously mentioned.

Figure 8:
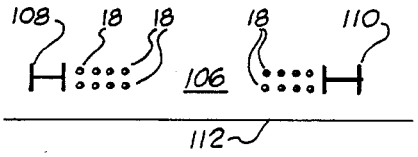
FIG. 8 is a top plan view, taken along line 8—8 of FIG. 5, showing the bolt placement.

Referring now to FIG. 8 there is shown a plan view looking from line 8—8 of FIG. 5, showing the placement of the high-strength bolts 18 in the concrete floor 106. The bolts 18 would be positioned in close proximity to the steel beams 108 and 110 on each floor near the edge 112 of the concrete floor 106. By referring to FIG. 1 also, the bolts 18 would then be embedded in each floor 1, 2, 3 etc. in the area where the formerly used man-lift 12 was positioned. The plurality of outriggers 20, 21, 22, 23, 24 and 25 would then be bolted to the plurality of bolts 18 as needed during the use of the lift both in its horizontal boom use position and in its vertically positioned boom placement as it is raised or lowered.

Figures 9, 10, 11:
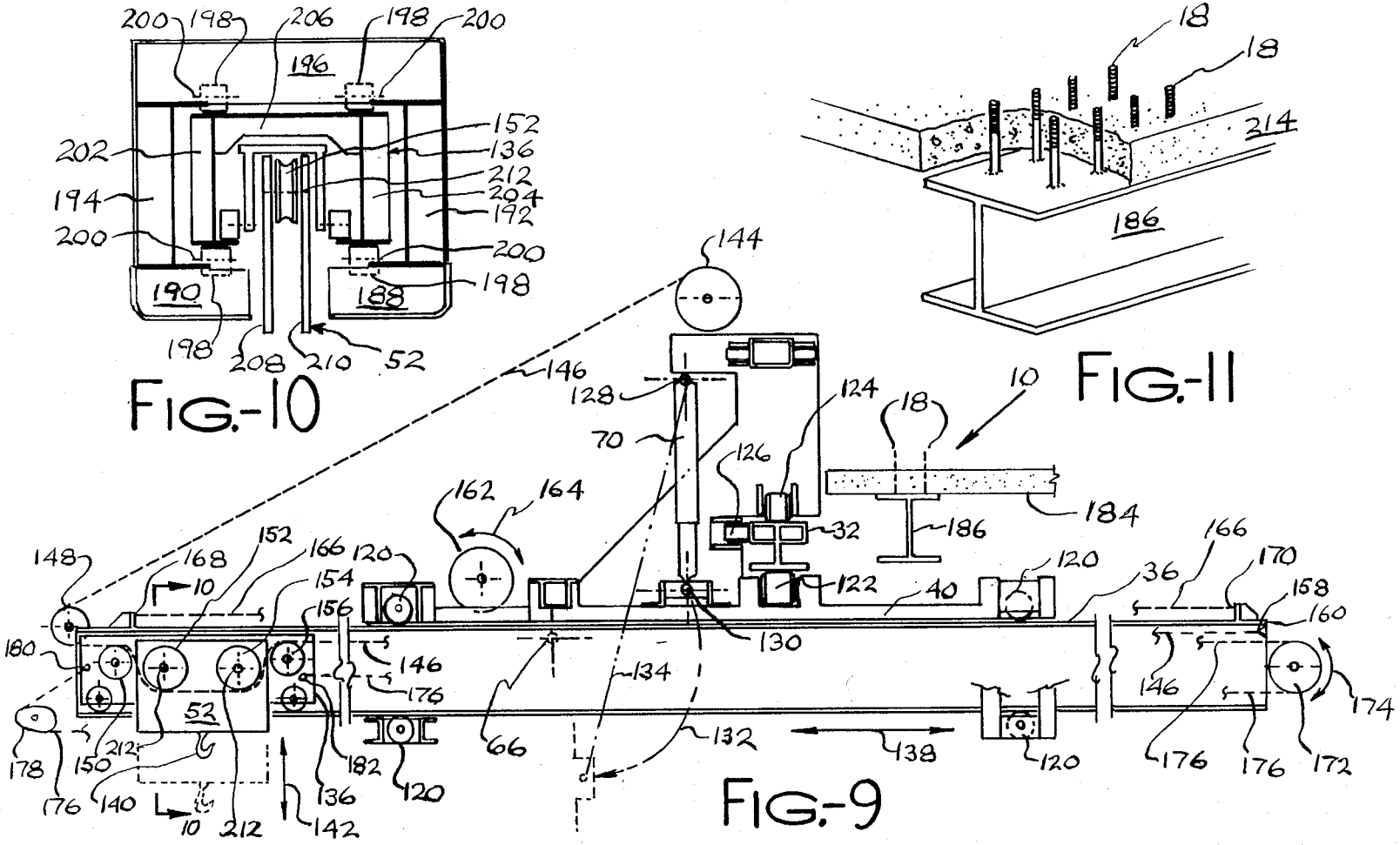
FIG. 9 is a cross section of the boom, taken along line 9—9 of FIG. 2, showing in greater detail the engineered boom, boom carriage and trolley with the disappearing cargo block nested within the trolley when a load of cargo is fully raised.
FIG. 10 is a sectional view taken along line 10—10 of FIG. 9 showing the trolley positioned within the boom and the cargo block positioned within the trolley.
FIG. 11 is a breakaway section of the bolts shown in FIG. 8.

Referring now to FIG. 9 there is shown a cross section of the boom, taken along line 9—9 of FIG. 2, showing in greater detail the boom structure as it would look after being engineered for installation at a job site.

The boom 36 is slidably carried in the boom carriage 40 by means of the plurality of rollers 120. The horizontal frame 32 carries the boom carriage 40 for transverse movement by means of the plurality of rollers 122, 124, and 126. The boom carriage 40 is pivoted on the pin 66 and may be vertically moved to the non-operative position by the hydraulic ram 70 which is pivotably attached to the upper portion of the boom carriage 40 at the pin 128 and to the lower portion of the boom carriage 40 by the pin 130. When pivoted thusly, the boom carriage 40 and the boom 36 will pivot in the direction shown by the arrow 132 after the hydraulic ram is extended to the distance shown by the dot/dash line 134.

A trolley 136 is carried by the boom 36 and is positioned within the boom for horizontal movement in the direction shown by the arrow 138. A disappearing cargo block 52 having a lifting hook 140 attached is designed for horizontal movement in the direction shown by the arrow. The use of the cargo block 52 positioned within the trolley 136 allows the applicant's lifting device 10 to function within the floor to ceiling space of the building structure under construction.

The cargo block power unit 144 is positioned above the boom carriage 40 as shown and operates to raise or lower the cargo block 52 through the operation of the cable 146 and the pulleys 148, 150, 152, 154, 156. The cable 146 is dead ended on the pin 158 at the inner edge 160 of the boom 36.

The boom power unit 162 is positioned on the boom carriage 40 and is designed to rotate in the direction shown by the arrow 164. The boom cable 166 is dead ended on the one end of the boom 36 at the pin 168 and at the other end of the boom at the pin 170 after being wrapped around the winding drum of the power unit 162.

A trolley power unit 172 is mounted on the edge 160 of the boom 36 and is designed to rotate in the direction shown by the arrow 174. A trolley cable 176 is used to drive the trolley horizontally in the boom 36 by being positioned around a pulley 178 and dead ended on the trolley 136 at the pins 180 and 182. The placement of the pulley 178 is shown in FIG. 9 in diagrammatic form because of space limitations on the drawing and would be as utilized in boom and trolley design. The entire lifting device 10 would be positioned below the floor 184 and below the structural steel 186 and would be attached to the structure as before mentioned to the bolts 18.

Referring now to FIG. 10 of the drawing, there is shown a cross-section view taken through line 10—10 of FIG. 9. The boom 36 would be fabricated in the generally inverted U-shape as shown and would have a pair of spaced apart, lower elongated frames 188 and 190 carried by the vertical frames 192 and 194 which are fixed to the upper horizontal frame 196. A plurality of rollers 198 are rotatably mounted in the frames by means of the pins 200. The trolley 136 would be formed by the frames 202 and 204 fixedly attached to the frame 206 and would be carried by the plurality of rollers 198 within the boom 36. The disappearing cargo block 52 would be formed by a pair of parallel plates 208 and 210 which would carry the pulleys 152 and 154 on the pins 212.

It can be seen in FIGS. 9 and 10 how the cargo block 52 is positioned almost totally within the trolley 136 whenever the cargo block is raised upwards when lifting a load thereby providing improved head room between the floor and the bottom of the boom.

Referring now to FIG. 11, there is shown a cut-away of the area where the bolts 18 would be attached to the structural beam 186 as shown in FIG. 9. The bolts 18 could be welded to the beam or to a separate plate which would be welded to the beam before the concrete floor 214 is poured.

From the foregoing, it can be seen that there has been provided by the subject invention, a new and novel lifting device which may be utilized on a high-rise building to eliminate all but one of the existing man lifts presently positioned on a high-rise building under construction. The applicant's self-climbing lift is able to be used by one operator to completely stock a floor under construction and is also able to be used to lift and turn the large bulky facing panels 90° so that they can then be moved into the building as needed. By the use of the parallel traveling booms 34 and 36 with their cargo blocks 52, it can be seen how a large and bulky facing panel and other long items may be picked up with each individual cargo block 52 on the parallel booms and can be raised up the side of the building. When in position, the trolleys and boom can be manipulated to turn the item approximately 90° whereupon it can be moved to the interior of the building. By use of the hydraulic power units, previously mentioned, the booms 34 and 36 may be moved in and out of the building in the direction shown by the arrow 85 in FIG. 2 and the cargo blocks may be dropped to the ground floor in the direction shown by the arrow 142 in FIG. 9. The twin booms 34 and 36 may also be moved a pre-determined amount within limits in the direction shown by the arrow 84 in FIG. 2. By use of the applicant's invention, the expensive tower crane may be removed after it has been used to completely erect the building steel framework with the facing panel lifting then being completely accomplished with the applicant's self-climbing lifting device. Since an existing tower crane cannot do facing panel erection until the building steel is topped out, the use of the applicant's self-climbing lift feature allows the facing of the building to follow the concrete pouring on the floors of the building after the concrete has been set by three or four stories. The high-strength bolts 18 will have been previously positioned in the outer edges of the one section of floors prior to the pouring of the concrete floors. Such elimination of the tower crane upon completion of the steel skeleton then saves the contractor an estimated minimum amount of 25 thousand dollars a month resulting in lower building costs which can be passed on to the building tenants by the owner of the building.

By the use of the applicant's self-climbing lift feature of the type shown, the facing on a building that is faced with facing panel should be accomplished in approximately one week per floor inasmuch as an average floor would utilize 15 men working per floor along with the tower crane to complete the facing erection under normal construction techniques.

It is within the spirit and scope of the invention that safety tie-back cables may be attached to the vertically positioned frames 26 and 28 to add more structural safety to the lift unit during operation of the booms 34 and 36. The tie-back safety cables may be positioned on the vertical frames 26 and 28 and may extend interiorly of the building to various steel columns to insure that vertical weight on the applicant's lift is taken only by the hydraulic rams used in the lift. With the applicant's novel lift design, the horizontal booms 34 and 36 are able to completely stock each floor within the allotted floor-to-floor space of 12 to 13 foot. The applicant's two parallel booms 34 and 36 shown in the preferred embodiment are designed to overcome the normal wind factor and swirling factor on the lifted facing panel thereby allowing facing erection to continue in higher wind conditions than heretofore possible by the use of existing tower cranes.

It is contemplated that the hydraulic motors necessary to power the power units of the invention would be in the range of 100 horsepower and it is also contemplated that the weight of the entire high-rise lift should not exceed 5–10 tons thereby allowing the lift to be easily raised from floor-to-floor by means of the hydraulic rams 54 and 56. It is also within the spirit and scope of the invention that the hydraulic lifting rams 54 and 56 could be replaced by electrical motors, mechanical worms and other lifting devices. It is also within the spirit and scope of the invention that the entire self-climbing lift could be fabricated in a less expensive version by the elimination of the hydraulic rams 54 and 56 and utilizing an exterior crane to lift the structure from floor-to-floor as desired. It is felt that the length of the booms 34 and 36 should be approximately 30 feet long to allow sufficient travel upwards on the outside of the building as the load 50 is raised upwardly and to transfer the load to the inside of the building where the erection crews can use the materials as desired. The movement of the booms 34 and 36 in and out of the building in the direction shown by the arrow 85 in FIG. 2 will be controlled by the operator of the lift.

The applicant's new and novel lifting device can be used on a high-rise building or on an oil drilling off-shore rig. It can be permanently mounted with either one or two booms on a completed building and can be pivoted to a vertical non-operative position on the outside of the building. It could then be hidden from view by a facing panel section designed to blend with the building exterior. The applicant's novel device in a modified form could also be permanently mounted on each floor of an off-shore drilling rig in either a single or twin boom configuration.

From the foregoing it can be seen that there has been provided by the subject application a new and novel self-climbing high-rise lift in the preferred embodiment which accomplishes all the objects and advantages of the invention. Nevertheless, it should be apparent from a review of the specifications and from a study of the drawings that many changes may be made in the arrangement of parts of the device and use of various materials in the device without departing from the spirit and scope of the invention. Other changes can be made in the method steps without departing from the invention's scope. The preferred embodiment has been given by way of illustration only.

Having described my invention, I claim:

1. A lifting device for use on the outside of a structure and designed for lifting elongated objects from a lower elevation outside of the structure to a higher elevation inside the structure by turning the elongated object when required, comprising:

(a) a generally vertical frame;

(b) means for attaching the frame to the structure;

(c) a pair of boom carriages mounted on the frame and designed for a normal operative position horizontally on the frame so that a portion of the boom carriages are located within the structure and a portion of the boom carriages are located outside the structure;

(d) means, associated with the frame and each boom carriage, for horizontally positioning the boom carriages on the frame at pre-determined positions for independent transverse movement along the structure on the frame within pre-determined limits;

(e) a movable boom positioned within each boom carriage and movable horizontally within the boom carriages within pre-determined limits;

(f) a trolley and cargo block positioned in and carried by each boom;

(g) activating means, associated with the frame, boom carriages, boom trolleys and cargo blocks for raising and lowering the cargo blocks and moving the trolleys and cargo blocks along the booms, the activating means capable of also moving the booms within the boom carriages into and out of the structure, and moving the boom carriages and booms apart or together as desired; the combined action of the activating means serving to allow an elongated object to be picked up by the cargo blocks and to be raised to a desired upper elevation whereupon the object may be turned from a transverse position to a longitudinal position and may then be moved into the structure.

2. The lifting device as defined in claim 1 further comprising the means for attaching the frame to the structure comprising a removable mounting means for mounting the frame to at least two elevations of the structure and further comprising lifting means, attached to the upper portion of the frame, for lifting the frame to a different elevation of the structure when desired.

3. The lifting device as defined in claim 1 further comprising the means for horizontally positioning the boom carriages to move transversely comprises a pair of hydraulic rams fixedly attached to the frame and to each boom carriage.

4. The lifting device as defined in claim 2 further comprising the lifting means comprising a pair of hydraulic rams fixedly attached to the frame and having fixed thereto a pair of outriggers for attaching to the structure.

5. The lifting device as defined in claim 1 further comprising the boom carriages being pivotably mounted on the frame and further comprising pivoting means, associated with the frame and the boom carriages for pivoting the boom carriages from a normal operative position to a vertical inoperative position while located on the outside of the structure.

6. A method for quickly stocking the respective floor of a structure with cargo that may be larger than the width of a single bay of the structure, comprising the steps of:

(a) providing a lift for attaching to the side of the structure;

(b) providing at least two horizontal booms on the lift, the booms being capable of movement into and out of the building; and towards and away from each other in a transverse direction;

(c) providing a movable trolley within each boom for movement within the booms;

(d) providing cargo block for each boom trolley for attaching to the cargo to be lifted;

(e) providing the means for activating the various parts at pre-determined times;

(f) lifting the cargo by the two cargo blocks until the blocks are positioned within the trolleys;

(g) moving the trolleys in opposite directions along their booms while moving the booms toward or away from each other thereby turning the cargo from a transverse direction to a longitudinal direction and pointing one end of the cargo into the structure; and (h) moving both trolleys and booms into the structure thereby moving the entire length of the cargo into the structure where it may be set down on the structure floor and disconnected from the cargo blocks.

7. The method as defined in claim 6 further comprising the steps of:

(i) repeating steps (f)–(h) until the entire floor is stocked.

8. The method as defined in claim 7 further comprising providing the lift with a self-climbing feature and the booms with means to raise to a vertical position; and further comprising the steps of:

(j) raising the booms to a vertical position;

(k) raising the lift to the next floor of the structure with its self-climbing features;

(l) lowering the booms to the horizontal position; and (m) repeating steps (f)–(h) until the next entire floor is stocked.

* * * * *